US005890377A

United States Patent [19]

Foglietta

[11] Patent Number: 5,890,377

[45] Date of Patent: Apr. 6, 1999

[54] HYDROCARBON GAS SEPARATION PROCESS

[75] Inventor: Jorge Hugo Foglietta, Missouri City, Tex.

[73] Assignee: ABB Randall Corporation, Houston, Tex.

[21] Appl. No.: 963,770

[22] Filed: Nov. 4, 1997

[51] Int. Cl.[6] ..... F25J 3/02

[52] U.S. Cl. ..... 62/621; 62/619

[58] Field of Search ..... 62/621, 619

[56] References Cited

U.S. PATENT DOCUMENTS

| | | | |
|---|---|---|---|
| 4,851,020 | 7/1989 | Montgomery, IV | 62/24 |
| 4,889,545 | 12/1989 | Campbell et al. | 62/621 |
| 4,895,584 | 1/1990 | Buck et al. | 62/621 |
| 5,566,554 | 10/1996 | Vijayaraghavan et al. | 62/621 |
| 5,568,737 | 10/1996 | Campbell et al. | 62/621 |

*Primary Examiner*—Ronald Capossela
*Attorney, Agent, or Firm*—Charles D. Gunter, Jr.

[57] ABSTRACT

A process for separating the components of a feed gas containing methane and heavier hydrocarbons is shown in which a recycle stream is used to satisfy the heat requirements of the process while at the same time providing a reflux to a demethanizer column to improve product recovery. The inlet gas stream is fed to a separator without first splitting the stream. A first vapor portion and a first liquid portion are produced by the separator with the first vapor portion being supplied, after expansion, to the demethanizer column at an intermediate feed position. The first liquid portion from the separator is expanded and supplied to the demethanizer column at a relatively lower feed position. Overhead vapor is removed from the column and compressed to a higher pressure. The resulting compressed recycle stream is cooled sufficiently to substantially condense it and is supplied as reflux to the demethanizer column at a top feed position.

9 Claims, 2 Drawing Sheets

HYDROCARBON GAS SEPARATION PROCESS

BACKGROUND OF THE INVENTION

1. Field of the Invention

The present invention is directed generally to a process for separating hydrocarbon gas constituents and, more specifically, to a cryogenic process for separating components of natural gas.

2. Description of the Prior Art

Various cryogenic processes are known in the prior art for recovering ethane and heavier hydrocarbon components from multi-component gas streams including natural gas, refinery gas and synthetic gas streams, comprised primarily of methane. Natural gas usually has a major proportion of methane and ethane, with these two components comprising at least about 50 mole percent of the total gas volume. The gas may also contain relatively lesser quantities of heavier components such as propane, butanes, pentanes, and the like, as well as hydrogen, nitrogen, helium, carbon dioxide, ethylene and other gases.

The process of the present invention is primarily concerned with the recovery of ethylene, ethane, propylene, propane and heavier hydrocarbons from feed gas streams containing primarily methane of the type described. A typical gas stream might contain, for example, about 90 weight percent methane; about 5 weight percent ethane, ethylene and other $C_2$ components; and about 5 weight percent heavier hydrocarbons such as propane, propylene, butanes, pentanes, etc. and nonhydrocarbon components such as nitrogen, carbon dioxide and sulfides.

Cryogenic processes have become popular in recent years for separating hydrocarbon gas constituents of the type described because of the availability of economical equipment that produces power while simultaneously expanding and extracting heat from the gas being processed. Such processes are now generally favored for ethane recovery, since they provide maximum simplicity with ease of start-up, operating flexibility, improved efficiency, safety and reliability.

In a typical prior art cryogenic expansion recovery process, a feed gas stream under pressure is cooled by heat exchange with other streams in the process and/or with external refrigeration means such as a propane compression-refrigeration system. As the feed gas cools, liquids may be condensed and collected in one or more separators as high pressure liquids containing certain of the desired $C_2$+ components. Depending on the richness of the gas feed and the amount of liquid formed, the high pressure liquids may be expanded to a lower pressure and fractionated. The vaporization occurring during expansion of the liquid results in further cooling of the stream. The expanded stream, comprising a mixture of liquid and vapor is fractionated in a demethanizer column. In the demethanizer column, the expanded and cooled streams are stripped or distilled to separate residual methane, nitrogen and other volatile gases as overhead vapor from the desired $C_2$ components, $C_3$ components, and heavier components as a bottom liquid product.

In this discussion, the term "demethanizer" will be taken to mean any device that can remove methane from a feed gas, including what is often referred to as a "deethanizer", which is designed to remove both methane and ethane. Such devices will be understood by those skilled in the art to include devices capable of removing methane from feed gases by the application of heat, including distillation, rectification and fractionation columns or towers. The exact member of trays or levels used in such columns will be subject to overall design considerations, efficiencies and optimization considerations.

A number of techniques are used in the prior art processes to both satisfy the heat requirements of the demethanizer and extract refrigeration from the overall process. A typical practice in the prior art cryogenic expansion recovery processes is to split the incoming feed gas stream into two streams, both having the same composition as the feed stream either before or after initial cooling. One of the split streams is typically processed so as to take advantage of the heat transfer capabilities inherently possessed by the feed gas, which typically has a higher temperature than other streams in the process.

The vapor from one of the streams is typically passed through a work expansion machine (turboexpander), or through an expansion valve, to lower the pressure so that additional liquids are condensed as a result of the further cooling of the stream. The pressure of the stream after expansion is essentially the same as the pressure at which the distillation column is operated. In such cases, the combined vapor-liquid phase is usually supplied as feed to the column.

In other cases, a vapor portion of the incoming feed is cooled to substantial condensation by heat exchange with other process streams. The resulting cooled stream is then expanded through a conventional expansion device, such as an expansion valve, to the pressure of the demethanizer. During expansion, a portion of the liquid will vaporize, resulting in cooling of the stream. The flash expanded stream is then supplied as a top feed to the demethanizer column. Typically, the vapor portion of the expanded stream and the demethanizer column overhead vapors combine as a residual methane product gas.

Under ideal conditions, the residue gas leaving the demethanizer column would contain substantially all of the methane in the feed gas with essentially none of the heavier hydrocarbon components and the bottom fraction leaving the demethanizer column would contain substantially all of the heavier components with virtually none of the methane or more volatile components. Under actual operating conditions, this ideal situation is not realized and the methane product of the process includes other vapors leaving the top fractionation stage of the column. As a result, there can be a considerable loss of $C_2$ components due to the fact that the top liquid feed contain substantial quantities of $C_2$ components and heavier components, resulting in these components leaving the top fractionation stage of the demethanizer as vapor.

It is possible to reduce the loss of desirable components from the column by contacting the rising vapors within the column with a reflux (liquid) which, preferably, contains very little $C_2$ components and heavier components. The return of a liquid reflux is desirable because it is the condensed liquid that increases the recovery percentage of the desired column bottoms product. Those skilled in the art will also appreciate that the reflux effect is optimized when the vapor recycle stream is totally or substantially condensed before expansion to the demethanizer operating pressure. Where a large portion of the reflux stream is still in the vapor state, the uncondensed vapor mixes with the residue gas in the demethanizer and both are discharged as overhead vapors, thereby decreasing product recovery. Preferably, the reflux is substantially condensed and is constituted so as to be capable of absorbing the majority of the $C_2$ components and heavier components from the overhead vapors of the column.

Various attempts have been made to improve the above described prior art processes. These attempts are primarily directed toward increasing ethane recovery while reducing external energy usage. The present invention provides an improved cryogenic expansion recovery process for separating hydrocarbon gas constituents having certain advantages, as will be discussed in detail below. The process of the invention can also be used advantageously in combination with the prior art processes.

It is therefore an object of the present invention to provide a cryogenic separation process for separating hydrocarbon gas constituents which increases the recovery of the desired components.

Another object of the invention is to provide an enhanced reflux process while lowering external energy requirements.

Another object of the invention is to provide such a process in which a reflux stream is returned to the top of the demethanizer column for increased ethane/propane recovery in the column bottoms product.

Another object of the invention is to provide a recycle stream that is substantially totally condensed, thereby maximizing the recovery of ethane/propane.

Another object is to reduce the recycle stream equipment required to provide the same amount of liquid reflux to the top of the demethanizer as is currently accomplished by existing schemes.

Another object of the invention is to reduce the number of expander-compressors and other equipment needed.

Another object of the invention is to utilize the lean residue gas, to reboil the demethanizer gas column, having thus the advantage of minimizing heat exchanger "pinching" due to gas richness.

Another object of the invention is to provide means to existing units using the existing conventional "split feed" process to retrofit their units to a high recovery process.

Another object of the invention is to utilize hot residue gas to reboil the demethanizer. Even when hot residue gas was used in other prior art schemes, it was never utilized as a part of recycle/reflux scheme as in Applicant's claimed invention.

SUMMARY OF THE INVENTION

A process is shown for separating components of a feed gas containing methane and heavier hydrocarbons. An inlet gas stream is feed to a separator, without first splitting the inlet gas stream. The separator produces a first vapor portion and a first liquid portion. The first vapor portion is supplied, after expansion, to a demethanizer column at an intermediate feed position. The first liquid portion is expanded to form an expanded stream and supplied to the demethanizer column at a relatively lower feed position. The overhead vapor from the column is removed and compressed to a higher pressure. The compressed recycle stream is cooled sufficiently to substantially condense it and is supplied as reflux to the demethanizer column as the top column feed.

Preferably, the inlet gas stream is cooled under pressure, prior to splitting the inlet gas stream, to provide a partially condensed, cooled stream. The partially condensed, cooled stream is separated in a high pressure separator into a first vapor portion and a first liquid portion. The first vapor portion is expanded in a turboexpander to further cool the stream and the cooled stream is introduced to the demethanizer column at an intermediate feed position. The first liquid portion from the separator is expanded and directed to the demethanizer column at a relatively lower feed position. The overhead vapor from the column is cooled and compressed to a higher pressure and thereafter divided into a volatile gas residue fraction and a compressed recycle stream. The compressed recycle stream is cooled sufficiently to substantially condense it by contacting it with the side reboilers provided as a part of the demethanizer column. The compressed recycle stream is further cooled and expanded to a lower pressure and supplied to the demethanizer column at a top feed position to reflux the column. The inlet gas stream can be cooled prior to entering the high pressure separator in a cooling stage by countercurrent flow with the overhead vapor from the demethanizer column and/or by external refrigeration means.

The process of the invention can also be combined with certain of the prior art processes while continuing to achieve the advantages of the improved process.

Additional objects, features and advantages will be apparent in the written description which follows.

DETAILED DESCRIPTION OF THE INVENTION

Figure 2:
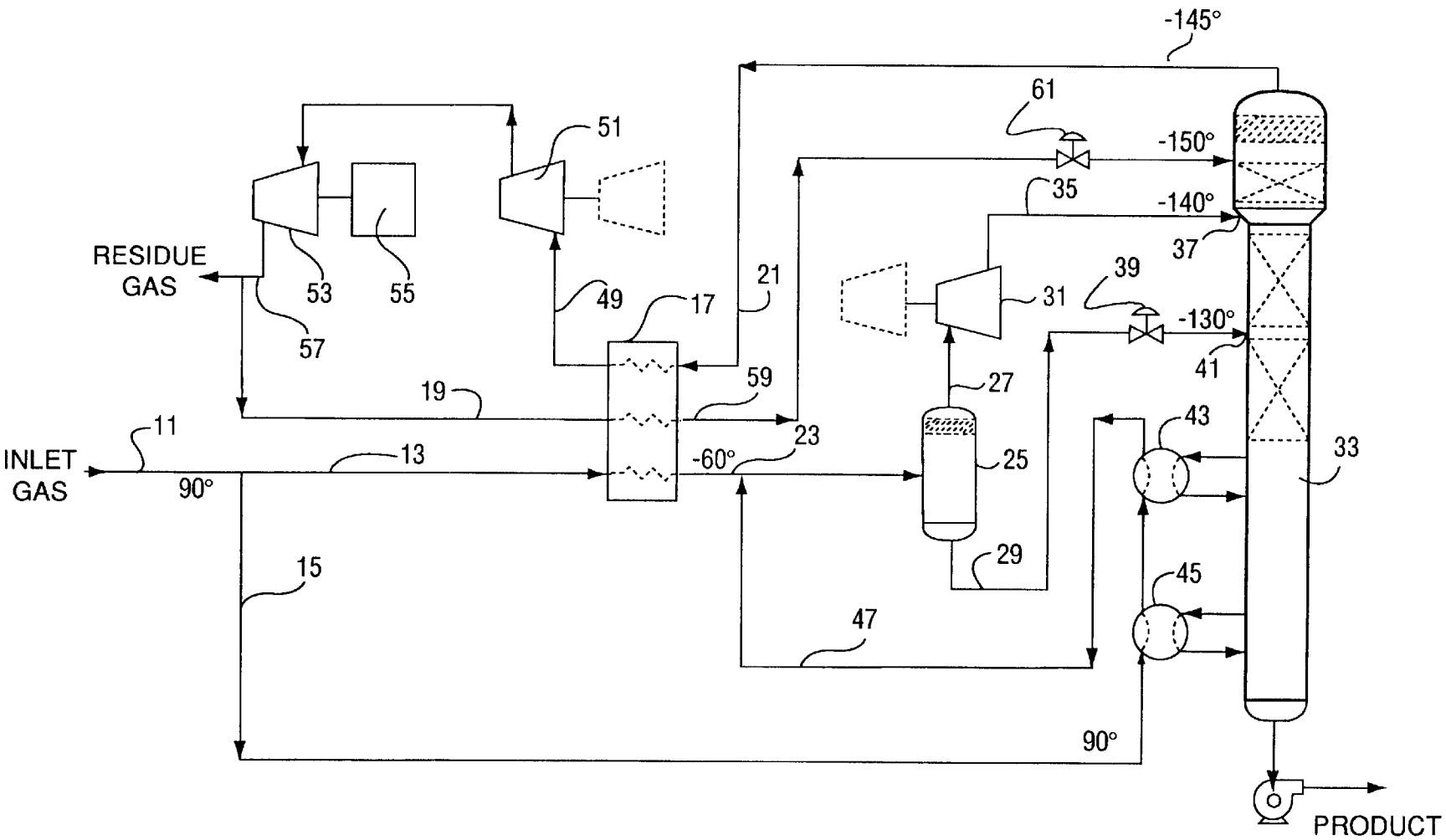
FIG. 2 (PRIOR ART)
FIG. 2 is a schematic flow diagram, similar to FIG. 1, showing the prior art technique.

In order to best understand the advantages offered by the present invention, a typical prior art process will first be considered. FIG. 2 shows a prior art cryogenic process for separating the constituents from multi-component feed gases. The inlet gas stream 11 will be taken to have an ambient temperature of about 90° F. It will be understood, however, that the inlet gas temperature typically varies between about 60° and 125° F., depending, for example, upon the ambient air temperature. The inlet gas stream 11 is a multi-component feed gas including lighter components such as methane and heavier gaseous components such as ethane, ethylene, propylene, propane and heavier hydrocarbons. The feed gas also typically includes non-hydrocarbon components such as carbon dioxide, nitrogen, helium, hydrogen and sulfides. The feed gas stream 11 may be taken from a natural gas or process gas stream, including refinery or synthesis gas streams. It will also be appreciated by those skilled in the art that the feed gas stream 11 is typically processed, prior to cooling, to remove the majority of the impurities including non-hydrocarbon components such as the sulfur and carbon dioxide constituents. The inlet gas stream 11 may also be compressed and dehydrated, prior to cooling, to minimize the water content.

The inlet gas stream 11, in FIG. 2, is split prior to cooling into two streams, 13, 15, both having the same composition as the inlet stream 11. The split stream 13 may be processed in a variety of ways to utilize the heat transfer capability possessed by the feed gas, which typically will be higher than the temperature of the other streams shown in the process of FIG. 2.

For the example illustrated, the split stream 13 is cooled in heat exchanger 17 to a lower temperature, for example in the range from about −30° to −85° F., in this case −60° F. The cooling can also be accomplished by any convenient means including an external means such as a chiller, series of chillers, or other known refrigeration mechanisms and may have various recycle configurations. In the example of FIG. 2, the single heat exchanger 17 is used to accomplish the heating and cooling of the various streams, particularly the initial cooling of the inlet gas stream 11. A conventional plate-fin heat exchanger may be utilized for these purposes.

It will also be noted that other streams are placed in heat exchange relation to the split stream 13 in heat exchanger 17, for example recycle compressed vapor stream 19 and overhead vapor stream 21.

The cooled inlet gas stream 23 is fed to a high pressure separator 25 which, in this case, is a conventional gas-liquid separation device. Stream 23 is typically a two-phase stream. In the separator 25, stream 23 is separated into a vapor portion 27, which is at least predominantly vapor, and a liquid portion 29 which is at least predominantly liquid. While the process illustrated shows the stream 23 being separated immediately after the heat exchanger 17, those skilled in the art will appreciate that additional processing of stream 23 could take place prior to its introduction to the separator 25, including one or more separation and/or cooling steps. Also, while the cooling steps shown in FIG. 2 are separate process steps from the separator vessel 25, it will be appreciated that cooling and separation could be accomplished in a single device. The vapor portion 27 exiting the separator 25 has a first composition which is typically predominantly methane but which will vary depending upon the richness of the feed gas and other factors, such as the operating conditions of the separator 25. The liquid stream 29 exiting the separator 25 has a different composition and typically has a higher concentration of the heavier components of the inlet gas stream 11.

The separator 25 is referred to herein as the "high pressure separator" and operates at a pressure which approximates that of the inlet feed gas 11, which may be provided from a pipeline or other source of pressurized gas. In the example illustrated in FIG. 2, the pressure in the separator 25 is assumed to be in the range from about 400 to 1400 psig, for example, 800 psig.

The vapor stream 27 from the high pressure separator 25 passes to a turboexpander 31 where the pressure and temperature of the vapor stream are reduced. While a "turboexpander" is illustrated in FIG. 2, it will be appreciated that any appropriate expansion device could be utilized, such as an expansion valve, or any other work expansion type machine or engine that is capable of lowering the pressure of a hydrocarbon stream. The turboexpander 31 typically reduces the pressure of the vapor stream to, for example, the operating pressure of the demethanizer column 33. In the example illustrated in FIG. 2, this pressure can be assumed to the in the range from about 160 to 500 psig. Additionally, the temperature is reduced to the range from about −70° to −180° F., for example to about −140° F., at which temperature it enters the demethanizer 33. The stream 35 from the turboexpander 31 flows to the demethanizer column 33 at an intermediate feed position 37.

While the stream 27 is shown in FIG. 2 as being directed toward the demethanizer column 33, it will be understood that the stream could be further processed and changed prior to passing to that final destination, for example, by changing the temperature, pressure or vapor-liquid composition.

The condensed liquid portion 29 existing the high pressure separator 25 is reduced in pressure in a controlled expansion valve 39 to further vaporize light hydrocarbon components in the liquid portion of the stream and is fed to the demethanizer column 33 at a relatively lower feed point 41 below the feed point 37. In the embodiment of FIG. 2, the stream 29 is expanded in the expansion valve 39 to provide a two-phase stream which is directed to the feed location 41 of the demethanizer 36. In the example shown, the temperature may be reduced in the expansion valve so that the temperature remains at about −130° and the pressure being approximately that of the operating pressure of the demethanizer 33.

Split inlet gas stream 15 may be directed in a variety of ways and configurations to transfer heat effectively among the various streams utilized in the process. In the example of FIG. 2, the stream 15 passes through the side reboilers 43, 45 of the demethanizer column 33. By exchanging heat with the streams from the demethanizer in the reboilers 43, 45, those streams are heated and partially vaporized while stream 47 is cooled. The outlet stream 47 is then recombined with the cooled stream 23 prior to entering the separator 25.

The overhead vapor steam 21 from the demethanizer 33 is used to provide cooling in the heat exchanger 17. Stream 49 exiting the heat exchanger 17 is partly compressed in a booster compressor 51, driven by turboexpander 31. A compression stage 53 may also be utilized and may be driven by a supplemental power source 55 to re-compress the residue gas to desired levels, for example, to meet pipeline pressure requirements.

The recycle stream 19 in FIG. 2 is cooled in heat exchanger 17 to form a substantially condensed stream 59 which is, thereafter, passed through the controlled expansion valve 61, where it is further cooled and the pressure of that stream is reduced to, preferably, the operating pressure of the demethanizer 33. Stream 59, in the example illustrated, is reduced in temperature to a temperature on the order of −150° F. Preferably, the temperature is lower than the temperature of the stream 35 being fed to the demethanizer 33.

The process of the invention will now be described in terms of the differences in the prior art process previously described.

Figure 1:
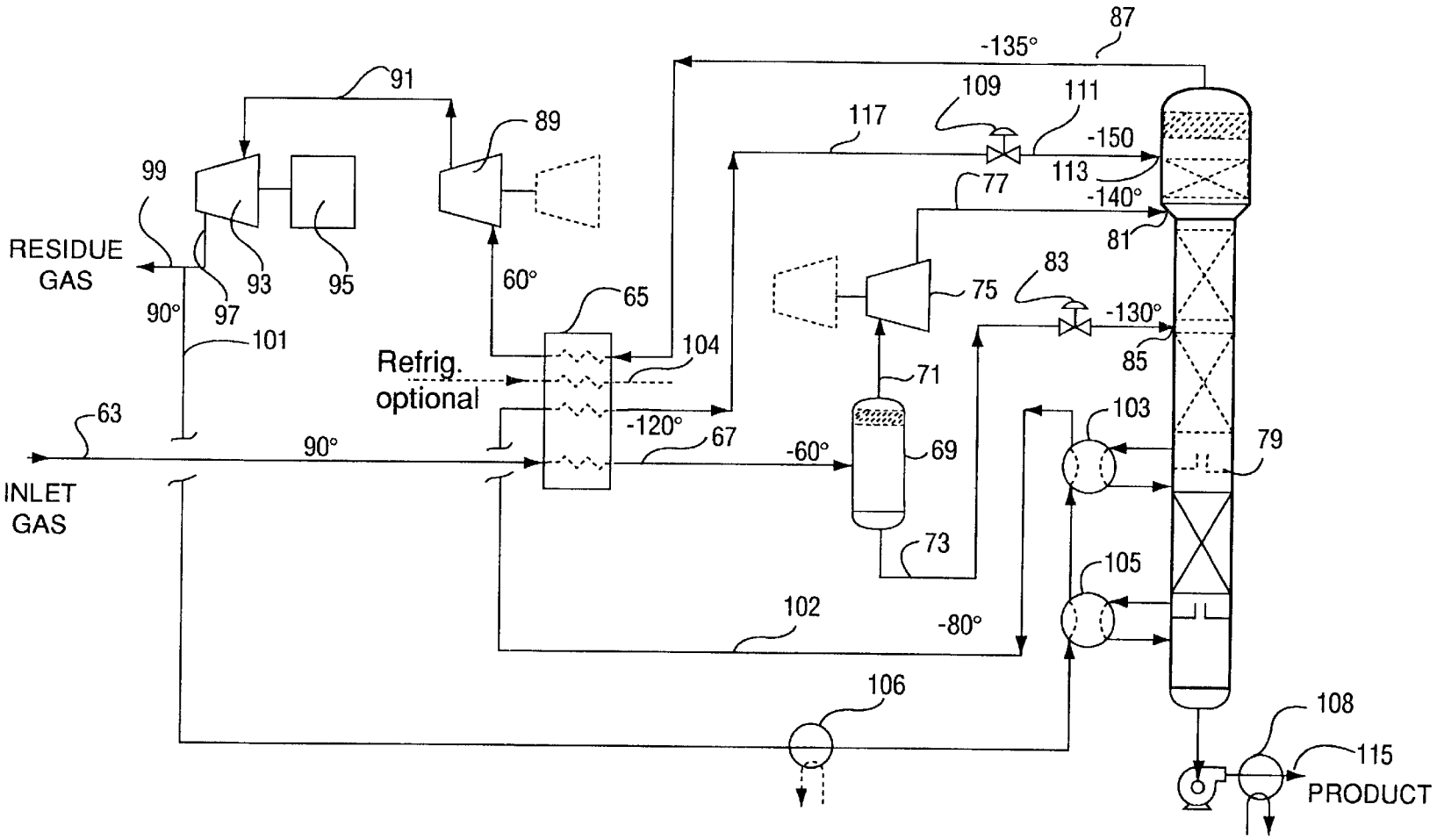
FIG. 1 is a schematic flow diagram illustrating the preferred embodiment of the present invention.

FIG. 1 shows the process of the invention which does not utilize an inlet gas split, as in the prior art process of FIG. 2. Instead, the process of FIG. 1 utilizes the recycle/reflux stream from the overhead vapor of the demethanizer to extract refrigeration from the process, as will be explained. In the example illustrated in FIG. 1, the inlet gas stream 63 at about 90° F. passes through heat exchanger 65 to provide a cooled stream 67 which is fed directly to the high pressure separator 69. Heat exchanger 65 reduces the temperature of the inlet gas stream to approximately −60° F. The separator 69 produces a first vapor portion or stream 71 and a first liquid portion or stream 73 therefrom. The first vapor portion 71 passes through turboexpander 75 to form an expanded stream 77 and is introduced to the demethanizer column 79 at an intermediate feed position 81. As in the example of FIG. 2, the temperature of stream 77 at the intermediate feed point 81 is approximately −140° F.

The first liquid portion 73 is expanded by means of controlled expansion valve 83 and supplied to the demethanizer column 79 at a relatively lower feed position 85. The temperature of stream 73 at the lower feed point 85 is approximately −130° F.

As has been mentioned, reflux processes notably improve the hydrocarbon recovery from gas separation systems such as the prior art system shown in FIG. 2. Typical cryogenic expansion plants split the inlet gas stream and use one of the split streams to extract refrigeration from the plant. When reflux is used, this stream is refrigerated by any of a variety of means with the cooled stream being injected at the top of the demethanizer column. The present process differs from the prior art in that no split of the inlet gas stream 63 is utilized. Instead, as will be explained, the process of the invention utilizes a recycle stream to satisfy the heat requirements of the demethanizer, while extracting refrigeration from the process, and with the recycle stream being condensed and sent as a reflux to the demethanizer to improve the product recovery. The process of the invention thus uses a recycle/reflux stream to extract refrigeration from the process, with the whole plant, in effect, being worked in recycle. Additional refrigeration can also be provided by the residue cold gas or by external means (indicated by dotted lines as 104 in FIG. 1). Recoveries have been found to be 95% and above for processes of the type illustrated in FIG. 1.

The operation of the recycle/reflux streams will now be described. Referring again to FIG. 1, the overhead vapor stream 87 at about −135° F. is first passed in countercurrent flow to the inlet gas stream in the heat exchanger 65 and thereafter passed to the booster compressor 89. Passing the overhead stream 87 through heat exchanger 65 warms it to the range from about 50°–80° F. Thereafter, the compressed stream 91 is further compressed to the sales line pressure by a compressor 93. Compression raises the temperature of the gas stream to the range from about 90°–120° F.

The compressed stream 97 exiting the compressor 93 is divided into a volatile residue gas fraction 99 and a compressed recycle stream 101. The compressed recycle stream 101, as shown in FIG. 1, is cooled to about −80° F. by passing the stream through the side reboilers 103, 105 of the demethanizer column 79 where it exits as stream 102. Further cooling occurs in the heat exchanger 65 to about −120° F. The compressed recycle stream 101 exits the heat exchanger 65 as a substantially condensed liquid in stream 107 and is reduced in pressure to substantially the pressure of the demethanizer column 79 by passing through controlled expansion valve 109 with the resulting reflux stream 111 being introduced to the demethanizer column 79 at a top feed position 113. Expansion of the stream in valve 109 lowers the temperature to about −150° F.

As has been previously discussed, returning liquid reflux through stream 111 to the top feed point 113 causes condensed liquid to pass in countercurrent flow to the upwardly rising vapors exiting the overhead vapor stream 87. The countercurrent flow increases the recovery percentage of the desired columns bottom product exiting through the liquid stream 115 since a high methane concentration and a low concentration of heavier hydrocarbons are excellent characteristics of a refluxing agent.

An invention has been provided with several advantages. The hydrocarbon gas separation process of the invention provides a recovery efficiency of 95% and greater without utilizing an inlet gas split. A portion of the residue gas stream is compressed, cooled and supplied as reflux at a top feed position to the demethanizer column in order to increase ethane recovery in the column bottoms product. The process is simple in design and manufacture and reduces external energy requirements.

While the invention has been shown in only one of its forms, it will be appreciated by those skilled in the art that it is not thus limited but is susceptible to various forms and modifications thereof. For example, a variety of temperatures and pressures may be used in accordance with the invention, depending upon the overall design of the system and the composition of the feed gas. Also, the feed gas cooling scheme, represented in schematic fashion by heat exchangers 65, 103 and 105 may be supplemented or reconfigured depending upon the overall design required to achieve optimum and efficient heat exchange requirements. For example, additional heat exchangers may be used as by the addition of heat exchangers 106, 108 (FIG. 1) and additional chillers and other refrigeration devices may likewise be used. Also, certain of the steps in the process may be accomplished by adding devices that are interchangeable with the devices shown. Thus, the specifically disclosed embodiments and examples of the invention should not be construed as limiting or restricting the scope of the invention.

What is claimed is:

1. A process for separating components of a feed gas containing methane and heavier hydrocarbons, the process comprising the steps of:

feeding an inlet gas stream to a demethanizer column to produce therefrom an overhead vapor stream and a liquid bottom fraction;

compressing the overhead vapor stream from the column to form a compressed recycle stream;

utilizing the compressed recycle stream to satisfy heat requirements of the demethanizer column sufficient to satisfy a desired heat balance for the demethanizer column while extracting refrigeration from the process;

condensing the compressed recycle stream to form a reflux and supplying the reflux to the demethanizer to control product recovery from the process.

2. A process for separating components of a feed gas containing methane and heavier hydrocarbons, the process comprising the steps of:

feeding an inlet gas stream to a demethanizer column to produce therefrom an overhead vapor stream containing predominantly methane and a bottom fraction containing predominately $C_2$ and $C_2^+$components;

compressing the overhead vapor stream to form a compressed recycle stream;

cooling the compressed recycle stream sufficiently to substantially condense it to a reflux stream by reboiling the demethanizer column while simultaneously satisfying heat requirements of the column;

supplying the condensed reflux stream to the demethanizer column as a top feed to thereby control product recovery from the process.

3. A process for separating components of a feed gas containing methane and heavier hydrocarbons, the process comprising the steps of:

feeding an inlet gas stream to a separator, without first splitting the inlet gas stream, the separator producing a first vapor portion and a first liquid portion therefrom;

supplying the first vapor portion, after expansion, to a demethanizer column at an intermediate feed position;

expanding the first liquid portion to form an expanded stream and supplying the expanded stream to the demethanizer column at a relatively lower feed position;

removing an overhead vapor stream from the demethanizer column;

compressing the overhead vapor stream to a higher pressure and thereafter dividing the stream into a volatile residue gas fraction and a compressed recycle stream;

cooling the compressed recycle stream sufficiently to substantially condense it while reboiling the demethanizer and supplying the condensed stream as reflux to the demethanizer column at a top feed position.

4. A process for separating components of a feed gas containing methane and heavier hydrocarbons, the process comprising the steps of:

feeding an inlet gas stream to a separator, without first splitting the inlet gas stream, the separator producing a first vapor portion and a first liquid portion therefrom;

supplying the first vapor portion, after expansion, to a demethanizer column at an intermediate feed position;

expanding the first liquid portion to form an expanded stream and supplying the expanded stream to the demethanizer column at a relatively lower feed position;

removing an overhead vapor stream from the demethanizer column;

compressing the overhead vapor stream to a higher pressure and thereafter dividing the stream into a volatile residue gas fraction and a compressed recycle stream;

cooling the compressed recycle stream sufficiently to substantially condense it while simultaneously providing heat to reboil the demethanizer column;

expanding the cooled compressed recycle stream to a lower pressure and supplying it to the demethanizer at a top feed position.

5. The process of claim 4, further comprising the steps of:

cooling the inlet gas stream under pressure to provide a cooled stream entering the separator.

6. The process of claim 5, wherein the compressed recycle stream is cooled sufficiently to substantially condense it by contact with the side reboilers provided as a part of the demethanizer column.

7. The process of claim 6, wherein the compressed recycle stream is further cooled in an additional cooling step and is thereafter expanded to approximately the pressure of the demethanizer column prior to being supplied to the column at the top feed position.

8. The process of claim 7, wherein the overhead vapor stream removed from the top of the demethanizer is passed in countercurrent flow to the inlet gas stream in a heat exchanger whereby the overhead vapor stream is warmed and the inlet gas stream is cooled prior to entering the separator.

9. A process for separation of a gas stream containing methane, $C_2$ components, $C_3$ components and heavier components, the process comprising the steps of:

cooling an inlet gas stream under pressure, prior to splitting the inlet gas stream, to provide a partially condensed, cooled stream;

separating the partially condensed, cooled stream in a high pressure separator into a first vapor portion and a first liquid portion;

expanding the first vapor portion in a turboexpander to further cool the stream and introducing the expanded stream to a demethanizer column at an intermediate feed position;

expanding the first liquid portion from the separator and directing the expanded liquid portion to the demethanizer column at a relatively lower feed position;

removing an overhead vapor stream from the demethanizer column;

passing the overhead vapor stream in countercurrent flow to the inlet gas stream in a heat exchanger to warm the overhead vapor stream and cool the inlet gas stream;

compressing the overhead vapor stream to a higher pressure and thereafter dividing the stream into a volatile residue gas fraction and a compressed recycle stream;

cooling the compressed recycle stream sufficiently to substantially condense it by contacting it with side reboilers provided as a part of the demethanizer column;

further cooling the compressed recycle stream;

expanding the cooled compressed recycle stream to a lower pressure and supplying it to the demethanizer at a top feed position.

* * * * *